US006877931B2

(12) United States Patent
Theurer et al.

(10) Patent No.: US 6,877,931 B2
(45) Date of Patent: Apr. 12, 2005

(54) TAMPING TINE FOR A TAMPING MACHINE

(75) Inventors: Josef Theurer, Vienna (AT); Friedrich Peitl, Linz (AT)

(73) Assignee: Franz Plasser Bahnbaumaschinen-Industrie-Gesellschaft, Vienna (AT)

( * ) Notice: Subject to any disclaimer, the term of this patent is extended or adjusted under 35 U.S.C. 154(b) by 43 days.

(21) Appl. No.: 10/347,537

(22) Filed: Jan. 17, 2003

(65) Prior Publication Data

US 2003/0133752 A1 Jul. 17, 2003

(30) Foreign Application Priority Data

Jan. 17, 2002 (AT) ..... GM22/2002

(51) Int. Cl.[7] ..... E01C 19/30; E01B 27/00

(52) U.S. Cl. ..... 404/133.05; 404/133.1; 104/10

(58) Field of Search ..... 37/104; 404/133.05, 404/133.1, 133.2; 104/10

(56) References Cited

U.S. PATENT DOCUMENTS 3,581,664 A * 6/1971 Kruse et al. ..... 104/10
3,729,055 A * 4/1973 Burridge ..... 172/719
3,793,960 A * 2/1974 McKenry ..... 104/10
3,971,323 A * 7/1976 Beiswenger ..... 104/10
4,062,291 A * 12/1977 Vick et al. ..... 104/10
4,068,594 A * 1/1978 Crowell ..... 104/10
4,160,419 A * 7/1979 Stewart ..... 104/10
4,315,464 A * 2/1982 Borden ..... 104/10
4,606,275 A * 8/1986 Grant ..... 104/10
4,848,240 A * 7/1989 Johansson et al. ..... 104/10
4,922,828 A * 5/1990 Theurer et al. ..... 104/10
4,996,925 A * 3/1991 Biermann ..... 104/10
5,261,763 A 11/1993 Crowell
5,809,895 A * 9/1998 Sandsted et al. ..... 104/10
6,551,018 B2 * 4/2003 Baker et al. ..... 404/102

* cited by examiner

*Primary Examiner*—Thomas B. Will
*Assistant Examiner*—Thomas A Beach
(74) *Attorney, Agent, or Firm*—Laurence A. Greenberg; Werner H. Stemer; Ralph E. Locher

(57) ABSTRACT

A tamping tine has a flat inclined tine surface that encloses an acute angle with a front surface of a tine plate at the lower end of a shank. The inclined tine surface is delimited, with regard to a longitudinal direction of the tamping tine, by a bottom edge of the tine plate and by a shank section line defined by an intersection of the inclined tine surface with the entire rear portion of the shank. A reference line on the inclined tine surface is distanced farther from an upper end point—positioned at the maximum distance from the bottom edge of the tine plate—of the inclined tine surface than from a shank end line. This ensures an easier penetration by the tamping tine into the ballast and it provides for an improved attachment of hardened metal plates for providing abrasion resistance.

9 Claims, 2 Drawing Sheets

Fig. 1
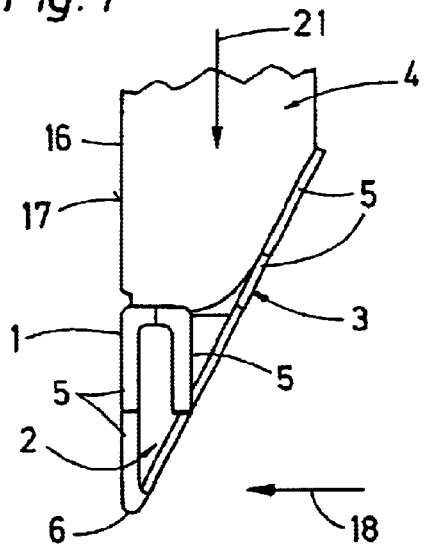
Fig. 2
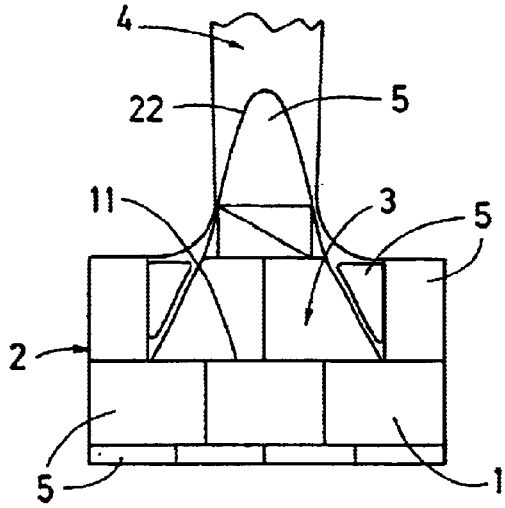
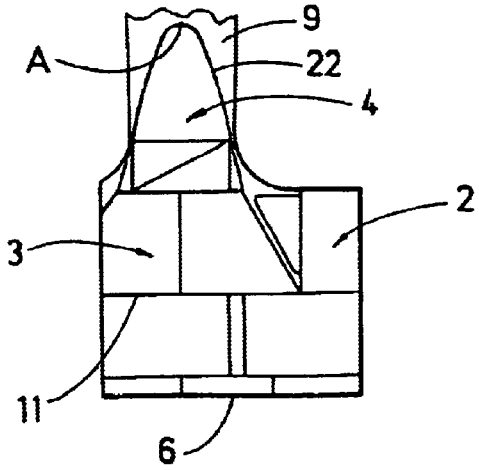
Fig. 6

TAMPING TINE FOR A TAMPING MACHINE

BACKGROUND OF THE INVENTION

Field of the Invention

The present invention relates, in general, to a tamping tine for a tamping machine for tamping ballast underneath a railroad track.

U.S. Pat. No. 5,261,763 to Crowell describes a tamping tine of this general type. That tamping tine, referred to as a tamping tool, has hardened metal plates that are fastened to both the tine pad and the lower end of the shank in order to optimize the resistance to abrasion during working operations. The lower end of the tine shank is formed with an offset and has a step-shaped recess for receiving the tine pad.

SUMMARY OF THE INVENTION

It is accordingly an object of the invention to provide a tamping tine for a tamping machine which overcomes the disadvantages of the heretofore-known devices and methods of this general type and which offers not only optimal abrasion resistance but also reduced resistance to penetration when the tamping tine is inserted into ballast.

With the foregoing and other objects in view there is provided, in accordance with the invention, a tamping tine for a tamping machine for tamping ballast underneath a railroad track, the tamping tine extending in a longitudinal direction and being movable in a tamping direction. The novel device comprises:

- a shank having a lower end and, with reference to the tamping direction, a front portion and a rear portion;
- a tine plate at the lower end of the shank, the tine plate having a bottom edge, spaced from the shank, a top edge, and, with reference to the tamping direction, a front surface and a rear surface, the rear surface and the shank forming a common shank end line extending parallel to the bottom edge of the tine plate;
- an inclined tine surface extending in a plane enclosing an acute angle with the front surface of the tine plate and intersecting an entire the rear portion of the shank along a shank section line, the inclined tine surface being delimited, with respect to the longitudinal direction, by the bottom edge of the tine plate and by the shank section line, the inclined tine surface having an upper end point at a maximum spacing from the bottom edge of the tine plate; and
- a reference line on the inclined tine surface defined by an intersection of the inclined tine surface with a reference plane extending perpendicularly to the front surface and along the top edge of the tine plate, the reference line being spaced farther from the upper end point of the inclined tine surface than from the shank end line.

In other words, according to one aspect of the present invention, there is provided a tamping tine for a tamping machine for tamping ballast underneath a railroad track, the tamping tine extending in a longitudinal direction and being movable in a tamping direction and including a shank having a lower end and a front portion and rear portion, with regard to the tamping direction. A tine plate is disposed or formed at the lower end of the shank and has a bottom edge, spaced from the shank, as well as a top edge, the tine plate including a front surface and a rear surface with regard to the tamping direction, the rear surface forming with the shank a common shank end line extending parallel to the bottom edge of the tine plate. An inclined tine surface extends in a plane enclosing an acute angle with the front surface of the tine plate and intersecting the entire rear portion of the shank in a shank section line, the inclined tine surface being delimited, with respect to the longitudinal direction, by the bottom edge of the tine plate and by the shank section line, with an upper end point of the inclined tine surface being maximally spaced from the bottom edge of the tine plate. A reference line is located on the inclined tine surface and is formed by intersection of the inclined tine surface with a reference plane extending perpendicularly to the front surface and through the top edge of the tine plate, the reference line being distanced farther from the upper end point of the inclined tine surface than from the shank end line.

In a tamping tine exhibiting the above-described combination of features, the lower end of the tine can be designed in an extreme wedge shape for achieving a reduction of the resistance to insertion or penetration. Extending the inclined tine surface to far above the upper edge of the tine plate makes it possible to minimize the entire cross-section of the shank without adversely affecting the required structural strength. By configuring the inclined tine surface as a plane, it is also possible, in an advantageous way, to avoid a bend line that would otherwise be subjected to increased abrasion.

In accordance with an added feature of the invention, the upper end point of the inclined tine surface and the reference line are spaced apart by a first spacing distance, the reference line and the shank end line are spaced apart by a second spacing distance, and the first spacing distance is greater by 20% to 50% than the second spacing distance.

In accordance with an additional feature of the invention, the acute angle enclosed between the inclined tine surface and the front surface of the tine plate lies between substantially 25° and substantially 35°.

In accordance with another feature of the invention, there are provided hardened metal plates substantially completely covering the inclined tine surface and the front surface of the tine plate.

In accordance with again an added feature of the invention, the reference line is at least 40% shorter than the shank end line.

In accordance with again an additional feature of the invention, the tamping plate has a given thickness measured in the tamping direction, and the reference line and the rear surface of the tine plate are spaced apart by a third spacing distance that is shorter than the thickness of the tine plate.

In accordance with again another feature of the invention, the tine plate and the shank are integrally forged in one piece.

In accordance with a concomitant feature of the invention, the shank has a front edge that is disposed in a common plane with the front surface of the tine plate.

Other features which are considered as characteristic for the invention are set forth in the appended claims.

Although the invention is illustrated and described herein as embodied in a tamping tine for a tamping machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a side elevational view of a lower portion of a tamping tine according to the invention;

FIG. 2 is a rear view of the tamping tine of FIG. 1;

FIG. 6 is a rear elevation of a variant embodiment of the tamping tine according to the invention.

DESCRIPTION OF THE PREFERRED EMBODIMENTS

Figure 4:
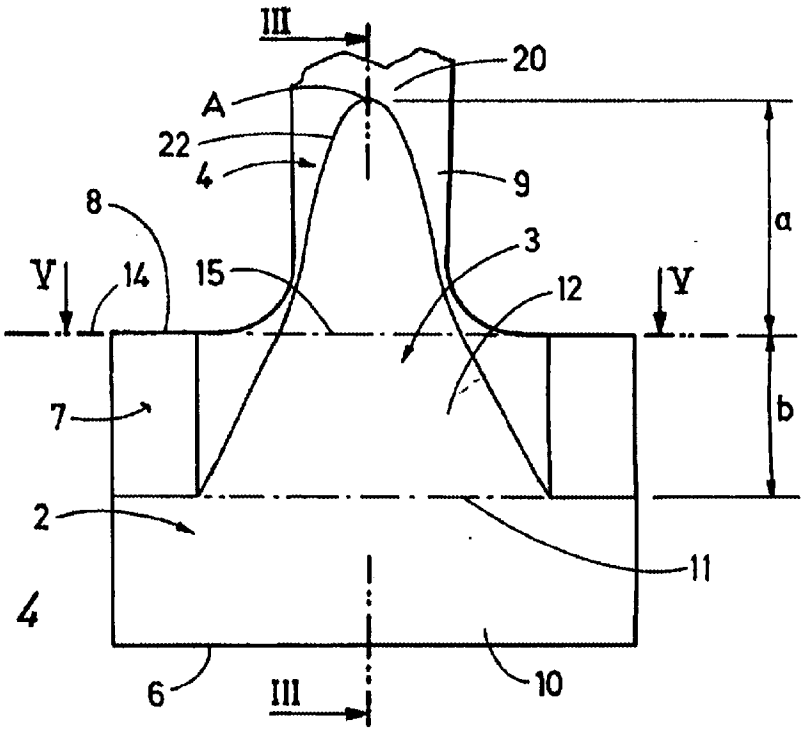
FIG. 4 is a rear view of the tamping tine of FIG. 1, illustrated to a different scale as compared with FIG. 2.

Referring now to the figures of the drawing in detail and first, particularly, to FIGS. 1, 2, and 4 thereof, there is shown a tamping tine 4 extending in a longitudinal direction 21 and having a shank 9. A tine plate 2 is disposed at the lower end of the shank 9. The tine plate 2 is formed with a front surface 1 and a rear surface 7, with respect to a tamping direction indicated by arrow 18, as well as with a top edge 8 and a bottom edge 6. The tine plate 2 merges into the shank 9 both in the region of the rear surface 7 and at the top edge 8. The tine plate 2 and the shank 9 are forged in one piece. With regard to the tamping direction 18, the shank 9 has a front portion 19 (see FIG. 3) and a rear portion 20.

The front surface 1 of the tine plate 2 as well as an inclined rear surface 3 of the tamping tine 4 are covered entirely with hardened metal plates 5 in order to increase the resistance to abrasion. (For better clarity, the hardened metal plates 5 are not shown in FIG. 4, nor in FIGS. 3 and 5.)

Figure 3:
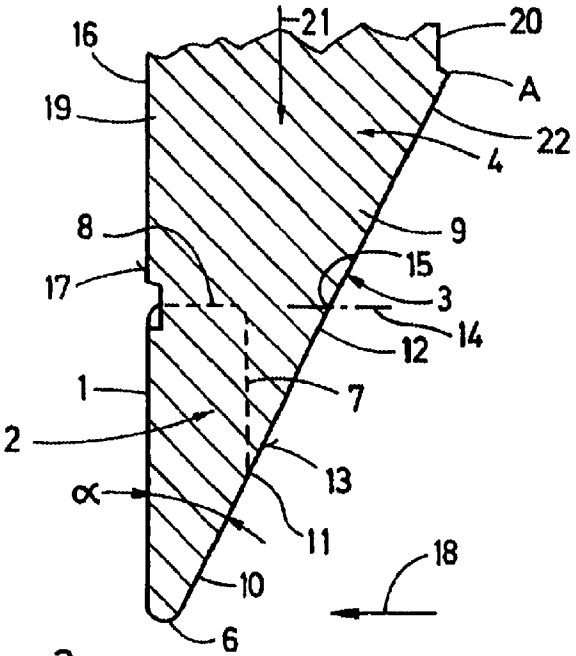
FIG. 3 is a section taken along the line III—III in FIG. 4 and viewed in a direction of the arrows.

With reference to FIGS. 3 and 4, the inclined tine surface 3 is composed of a lower segment 10, formed by a lower part of the rear surface 7 with regard to the longitudinal direction 21, and an upper segment 12 which is separated from the lower segment 10 by a shank end line 11 and delimited by a shank section line 22. The shank end line 11 is formed by the rear surface 7 and the shank 9 and extends parallel to the bottom edge 6 of the tine plate 2. The shank section line 22 defines the intersection between the inclined tine surface 3 and the rear portion 20 of the shank 9. The shank section line 22 further includes an upper end point A which is maximally distanced from the bottom edge 6 of the tine plate 2. The inclined tine surface 3 encloses an angle $\alpha$ of approximately 30° with the front surface 1 of the tine plate 2. The angle may expediently vary between about 25° and about 35°. The inclined tine surface 3 forms a plane 13, meaning that each line positioned in the inclined tine surface 3 and extending perpendicularly to the bottom edge 6 is a straight line.

A reference line 15 represents a line of intersection between the inclined tine surface 3 and a reference plane 14, the latter extending perpendicularly to the front surface 1 and through the upper edge 8 of the tine plate 2 (see FIGS. 3 and 4). A first distance a between this reference line 15 and the upper end point A is greater than a second distance b extending between the reference line 15 and the shank end line 11. Expediently, the first distance a may be greater by about 20% to 50% than the second distance b.

Figure 5:
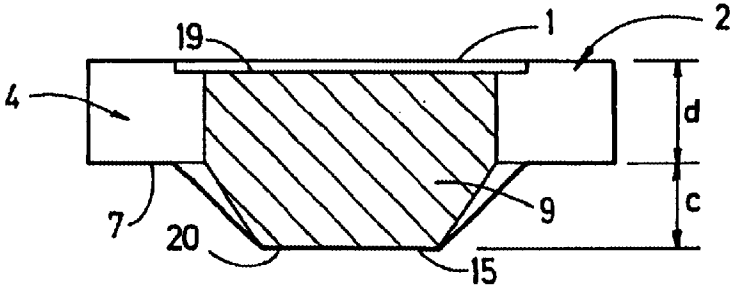
FIG. 5 is a section taken along the line V—V in FIG. 4 and viewed in a direction of the arrows.

With particular reference to FIG. 4, the reference line 15 is shorter by at least 40% than the shank end line 11. As shown in FIG. 5, a third distance c between the reference line 15 and the rear surface 7 is shorter than a thickness d of the tine plate 2, as measured in the tamping direction 18. This results in a reduction of the cross-sectional area of the tamping tine 4 for enabling the same to be inserted more easily into the ballast. From FIGS. 1 and 3 it may be seen that the front surface 1 of the tine plate 2 and a limit line or front edge 16 of the shank 9 are arranged in a common plane 17.

In the exemplary embodiment of a tamping tine 4 represented in FIG. 6, the tine plate 2 is configured asymmetrically with regard to the shank 9.

While the invention has been illustrated and described as embodied in a tamping tine for a tamping machine, it is not intended to be limited to the details illustrated and described, since various modifications and changes may be made without departing from the spirit of the present invention.

This application is based on and claims the priority benefit of Austrian application GM 22/2002, filed Jan. 17, 2002; the disclosure of the priority application is herewith incorporated by reference.

We claim:

1. A tamping tine for a tamping machine for tamping ballast underneath a railroad track, the tamping tine extending in a longitudinal direction and being movable in a tamping direction, comprising:

a shank having a lower end and, with reference to the tamping direction, a front portion and a rear portion;

a tine plate at said lower end of said shank, said tine plate having a bottom edge, spaced from said shank, a top edge, and, with reference to the tamping direction, a front surface and a rear surface, said rear surface and said shank forming a common shank end line extending parallel to said bottom edge of said tine plate;

an inclined tine surface extending in a plane enclosing an acute angle with said front surface of said tine plate and intersecting an entire said rear portion of said shank along a shank section line, said inclined tine surface being delimited, with respect to the longitudinal direction, by said bottom edge of said tine plate and by said shank section line, said inclined tine surface having an upper end point at a maximum spacing from said bottom edge of said tine plate; and a reference line on said inclined tine surface defined by an intersection of said inclined tine surface with a reference plane extending perpendicularly to said front surface and along said top edge of said tine plate, said reference line being spaced farther from said upper end point of said inclined tine surface than from said shank end line.

2. The tamping tine according to claim 1, wherein said upper end point of said inclined tine surface and said reference line are spaced apart by a first spacing distance, said reference line and said shank end line are spaced apart by a second spacing distance, and said first spacing distance is greater by 20% to 50% than said second spacing distance.

3. The tamping tine according to claim 1, wherein said acute angle enclosed between said inclined tine surface and said front surface of said tine plate lies between substantially 25° and substantially 35°.

4. The tamping tine according to claim 1, which further comprises hardened metal plates substantially completely covering said inclined tine surface and said front surface of said tine plate.

5. The tamping tine according to claim 1, wherein said reference line is at least 40% shorter than said shank end line.

6. The tamping tine according to claim 1, wherein said tamping plate has a given thickness measured in the tamping direction, and wherein said reference line and said rear surface of said tine plate are spaced apart by a third spacing distance shorter than said thickness of said tine plate.

7. The tamping tine according to claim 1, wherein said tine plate and said shank are forged in one piece.

8. The tamping tine according to claim 1, wherein said shank has a front edge disposed in a common plane with said front surface of the tine plate.

9. A tamping tine for a tamping machine, comprising:

a shank defining a longitudinal direction and having a lower end; and a tine plate at said lower end of said shank, said tine plate having a bottom edge, spaced from said shank, a top edge, a front surface and a rear surface, said rear surface and said shank forming a common shank end line parallel to said bottom edge of said tine plate;

said tine plate defining an inclined tine surface enclosing an acute angle with said front surface of said tine plate and intersecting said shank along a shank section line, said inclined tine surface being delimited, with respect to the longitudinal direction, by said bottom edge of said tine plate and by said shank section line, said inclined tine surface having an upper end point at a maximum spacing from said bottom edge of said tine plate; and wherein a reference line on said inclined tine surface is defined by an intersection of said inclined tine surface with a reference plane extending perpendicularly to said front surface and at said top edge of said tine plate, and said reference line is spaced farther from said upper end point of said inclined tine surface than from said shank end line.

* * * * *

UNITED STATES PATENT AND TRADEMARK OFFICE

CERTIFICATE OF CORRECTION

PATENT NO. : 6,877,931 B2
APPLICATION NO. : 10/347537
DATED : April 12, 2005
INVENTOR(S) : Josef Theurer et al.

It is certified that error appears in the above-identified patent and that said Letters Patent is hereby corrected as shown below:

Title Page
Item [73] should read as follows:

Franz Plasser Bahnbaumaschinen-Industrie-Gesellschaft mbH, Vienna (AT)

Signed and Sealed this

Seventeenth Day of April, 2007

JON W. DUDAS
*Director of the United States Patent and Trademark Office*